US009607482B2

(12) United States Patent
Mckay et al.

(10) Patent No.: US 9,607,482 B2
(45) Date of Patent: Mar. 28, 2017

(54) GAMING MACHINE WITH UPPER AND LOWER SYMBOL MATRICES AND SHARED CENTER REEL

(71) Applicant: IGT CANADA SOLUTIONS ULC, Moncton (CA)

(72) Inventors: Ginette Mckay, Las Vegas, NV (US); Shane Littlefield, Las Vegas, NV (US)

(73) Assignee: IGT Canada Solutions ULC, Moncton (CA)

( * ) Notice: Subject to any disclaimer, the term of this patent is extended or adjusted under 35 U.S.C. 154(b) by 450 days.

(21) Appl. No.: 14/171,127

(22) Filed: Feb. 3, 2014

(65) Prior Publication Data

US 2015/0072754 A1 Mar. 12, 2015

Related U.S. Application Data

(60) Provisional application No. 61/875,820, filed on Sep. 10, 2013.

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01)

(58) Field of Classification Search
CPC ... G07F 17/3213; G07F 17/3267; G07F 17/34
See application file for complete search history.

(56) References Cited

U.S. PATENT DOCUMENTS

2004/0033827 A1* 2/2004 Gilmore ..... G07F 17/32 463/20
2005/0130737 A1* 6/2005 Englman ..... G07F 17/32 463/25
2008/0182650 A1* 7/2008 Randall ..... G07F 17/32 463/25
2012/0077566 A1* 3/2012 Schultz ..... G07F 17/3244 463/20
2013/0244749 A1* 9/2013 Calvert ..... G07F 17/326 463/20
2014/0094249 A1* 4/2014 Gugler ..... G07F 17/34 463/20

* cited by examiner

*Primary Examiner* — Damon Pierce
(74) *Attorney, Agent, or Firm* — Sage Patent Group

(57) ABSTRACT

On a display screen in a gaming device is displayed an upper set of reels, a lower set of reels, and a larger shared reel that extends between the upper set of reels and the lower set of reels, the shared reel containing special symbols, wherein symbols on an upper section of the shared reel are combinable with symbols on the upper set of reels; and wherein symbols on a lower section of the shared reel are combinable with symbols on the lower set of reels. The special symbols may include wild symbols, free spin symbols, instant awards, mystery wild symbols, and secondary game play symbols. Since the player can focus on only one reel, the shared reel, which frequently determines whether the player wins, the player becomes more involved in the game and enjoys it more.

20 Claims, 4 Drawing Sheets

GAMING MACHINE WITH UPPER AND LOWER SYMBOL MATRICES AND SHARED CENTER REEL

CROSS-REFERENCE TO RELATED APPLICATIONS

This application claims priority from U.S. provisional application Ser. No. 61/875,820, filed on Sep. 10, 2013, assigned to the present assignee and incorporated herein by reference.

FIELD OF THE INVENTION

This invention relates to electronic gaming machines and, in particular, to a gaming machine displaying at least upper and lower sets of virtual reels with a shared center reel.

BACKGROUND

A typical video gaming machine displays a single matrix of symbols, such as a 3×5 matrix formed by five vertically oriented virtual reels, each displaying three symbols. The reels are spun and randomly stopped, and awards are granted for winning symbol combinations across pay lines.

Players may grow tired of such standard games and may like to play a different type of virtual-reels game that gives the player more opportunities to win. Further, for some players, it is difficult to follow the progress of the game since the five reels spin and stop rapidly.

What is needed is a variation of a virtual reels game that provides the player more opportunities to win and provides extra excitement by allowing the player to better follow the progress of the game.

SUMMARY

In one embodiment, the video gaming machine displays an upper 3×5 matrix of symbols and an independent bottom 3×5 matrix of symbols. The upper matrix is created by four reels, each displaying three vertically oriented symbols, plus the upper part of a larger, shared center reel that also displays three symbols within the upper matrix.

The lower matrix is created by four other reels, each displaying three vertically oriented symbols, plus the lower part of the center reel that also displays three symbols within the lower matrix.

A center symbol on the center reel is displayed between the upper and lower matrices. Therefore, the center reel displays seven symbols for each spin.

The reels other than the center reel contain ordinary symbols that are combined with other symbols on pay lines to form winning combinations. The shared center reel only contains special symbols, different from all the symbols on the other reels. The symbols on the center reel are more noticeable to the player when the center reel is spinning, since the center reel is large and displays potentially valuable symbols. In one embodiment, the center reel stops last to draw even more attention to it. Examples of symbols on the center reel include wild symbols, free spin symbols, instant awards, mystery wild symbols, and secondary game play symbols.

In addition to the symbols on the center reel being combined with other symbols in the upper and lower sets of reels, awards are also granted when the center reel itself displays a certain number of identical symbols, such as three free spin symbols (out of the seven symbols displayed by the center reel). Only by providing a large reel displaying many symbols is it practical to provide an award based on combinations of symbols displayed by the center reel.

In one embodiment, a certain symbol appearing anywhere on the center reel allows the player to play a secondary game. The symbols are arranged on the center reel so that only one of that certain symbol can appear when the center reel is stopped. In one embodiment, the certain symbol is a briefcase symbol, allowing the player to make a selection in a Deal Or No Deal game.

In one embodiment, certain symbols on the center reel are "activated" upon certain events occurring, such as the player making a high wager. Therefore, an unactivated symbol, such as a free spin bonus trigger symbol, may not trigger the free spin bonus, while an activated free spin bonus trigger symbol may trigger the free spin bonus. Other events for activating some of the special symbols may also be used. Selective activation of a symbol's function on the center reel allows the same symbols set and arrangement to be used on the center reel but changes the win probability.

In one embodiment, most of the symbols on the center reel are wild, and the remaining symbols have a variety of functions.

In the preferred embodiment, only the symbols on the center reel are used to play a secondary game, such as Deal Or No Deal. By confining the special symbols to the center reel and making the center reel prominent, the player can easily follow the spinning and stopping of the center reel, increasing the enjoyment of the game.

Other embodiments are described.

BRIEF DESCRIPTION OF THE DRAWINGS

Elements in the various figures that are the same or equivalent are labeled with the same numeral.

DETAILED DESCRIPTION

Figure 1:
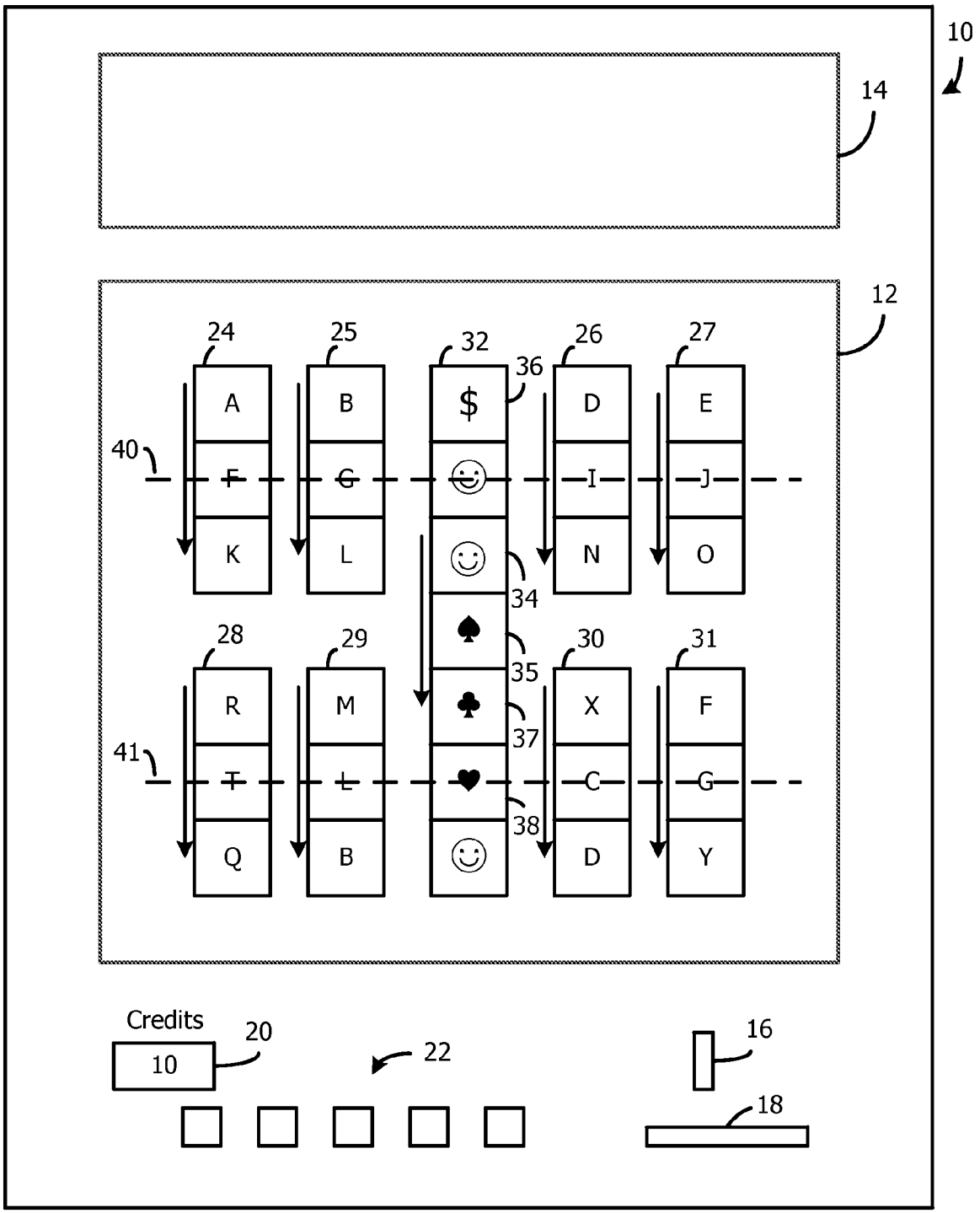
FIG. 1 is a front view of a conventional video gaming machine platform programmed to carry out the game in accordance with one embodiment of the invention, where a sample screen display is shown.

FIG. 1 illustrates an electronic gaming machine 10 having at least a main video display screen 12. A secondary screen 14 may display the game title, pay tables, a secondary game, or any other information.

The machine 10 may have a coin/token slot 16 for validating coins/tokens to create a bank of credits. The machine 10 has at least one slot 18 for reading credit codes on coupons, or validating bills, or dispensing printed coupons upon the player cashing out, or reading a player tracking card. A credit meter 20, which may be part of the screen 12, identifies the amount of credits stored in the machine 10. Player control buttons 22 allow the player to make wagers, initiate the game, and make other selections. The buttons 22 may be touch screen buttons on the screen 12.

The screen 12 shows an example of video reels used to play one embodiment of the game. The reels include upper reels 24, 25, 26, and 27, forming part of an upper 3×5 matrix of symbols, and bottom reels 28, 29, 30, and 31, forming part of a lower 3×5 matrix of symbols. Each of the reels 24-31 is independently spun and displays three vertically-oriented symbols. The reels 24-31 may be identical to each other, containing the same set of symbols in the same order. In another embodiment, the reels 24-31 may contain different, but overlapping, sets of symbols.

A center reel 32 displays seven symbols and is shared by the upper and lower sets of reels. The top three symbols of the center reel 32 are used in the upper 3×5 matrix of symbols, and the bottom three symbols on the center reel 32 are used in the lower 3×5 matrix of symbols. The remaining center symbol position may be designated as a special symbol position for awarding a high value special prize, such as a progressive jackpot, if a certain symbol is displayed at that location coupled with another event, such as a certain symbol combination in the 3×5 matrices.

In one embodiment, the center reel 32 only contains special symbols, which are all different from the symbols on the reels 24-31. These special symbols are generally more valuable than the symbols on the reels 24-31. For example, the symbols on the reels 24-31 may have no special functions and are used to combine with other symbols to create a winning combination of symbols. Certain combinations of symbols correspond to awards in a pay table (a memory), and the player is awarded credits for obtaining such winning combinations across pay lines in the 3×5 matrices. In one embodiment, there are 25 pay lines for each of the 3×5 matrices. FIG. 1 shows two of the pay lines 40 and 41.

The special symbols on the center reel 32 may include wild symbols 34, free spins symbols 35, instant awards 36, mystery wild symbols 37 that randomly make symbols on the other reels wild, and secondary game play symbols 38 that are used to play a secondary game. In one embodiment, the secondary game is Deal Or No Deal, and the display of a symbol 38 (e.g., a briefcase) anywhere on the center reel 32 allows the player to select a briefcase, representing a hidden amount of money, from any array of displayed briefcases. The screen 12 is a touchscreen, and the selections are by touching a briefcase icon. The player is then offered deals during play of the secondary game and tries to win the most money during the secondary game generally using the known rules of the famous Deal Or No Deal game. The secondary game is continually played over the course of many main games so the player is motivated to keep playing the machine 10 at least until the secondary game is finished.

In another embodiment, the some symbols on the center reel 32 may be the same as the symbols on the reels 24-31.

When all the reels 24-32 are spun after a wager, the player's attention is drawn to the spinning and stopping of the center reel 32 since it is larger, has the most valuable symbols, and, optionally, stops last. Since the player can focus on only one reel, which frequently determines whether the player wins, the player becomes more involved in the game and enjoys it more.

Figure 2:
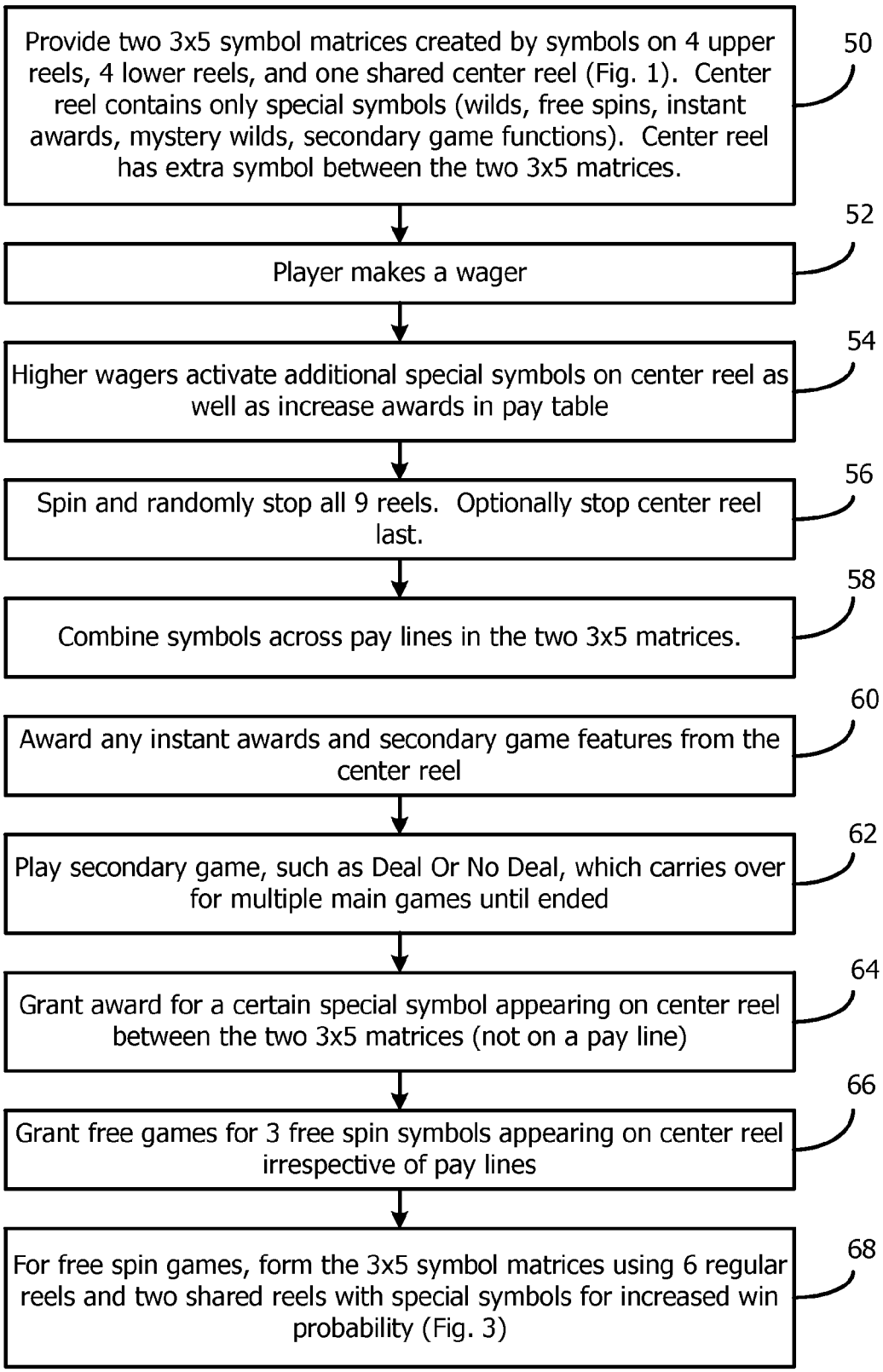
FIG. 2 is a flowchart of a game method utilizing the shared center reel shown in FIG. 1.

An example of a game method is provided in the flowchart of FIG. 2.

In step 50, the various reels 24-32 are provided on the screen 12, as discussed above.

In step 52, the player makes a wager, such as between one cent and $10 per pay line. Each game uses 50 pay lines, so the wagers may range between $0.50 and $500.

In one embodiment, the pay table (for associating winning combinations with awards) increases the awards proportionally to the amount bet. In addition to the awards increasing proportionally for the higher wagers, the special symbols on the center reel 32 may be varied to create a higher probability of winning, or, more generally, to increase the pay out percentage (step 54). For example, for low wagers, the long range pay out percentage (pay-out/pay-in) may be 88%, while for the highest wagers, the long range pay out percentage may be 96%. In one embodiment, the center reel 32 may have activated symbols of one type and unactivated symbols of the same type. The activated symbols may be brighter or identified in a different way. In one embodiment, the display of an activated secondary game feature symbol on the center reel 32 acts to allow the player to select a briefcase in the secondary Deal Or No Deal game. If the symbol was unactivated, the symbol does not allow the player to play the secondary game. In another embodiment, some subset of the free spin bonus trigger symbols (the free spins symbols 35) on the center reel 32 can be activated upon certain events occurring, such as the player placing a high wager. Any unactivated free spin bonus trigger symbols would therefore not function to award the free spins. Such activated symbols may instead grant the player an additional instant award or other benefit, such as multiplying an award. Therefore, by the player making a higher wager, the player readily sees the benefits (increased pay out percentage) by the activation of the symbols on the center reel 32. This technique also simplifies the design of the game when increasing the pay out percentage (e.g., increasing the win frequency), since only the significance of some symbols on the center reel is changed (activated or unactivated) rather than changing any random number generator or the pay table to change the pay out percentage.

In one embodiment, the pay table increases linearly with the wager, but more symbols are progressively activated on the center reel 32. Advertising such a feature encourages the player to place higher wagers.

In step 56, the reels 24-32 are spun and randomly stopped. The center reel 32 may optionally stop last to draw more attention to that reel and increase the excitement level. Since the symbols on the center reel 32 are typically high value symbols, the stop position of the center reel 32 is the most important to the player.

In step 58, the symbols combinations across the pay lines in the upper and lower matrices are determined by the pay table to be winning or losing combinations, and the appropriate amount of credits is awarded to the player.

In step 60, any instant awards from displayed symbols on the center reel 32 are paid to the player. For example, the pay table may only require the display of a particular symbol, such as symbol 36 in FIG. 1, to be displayed anywhere on the screen 12 in order to grant the player an instant award. The symbol 36 may also act as a wild symbol for purposes of creating symbol combinations in the 3×5 matrices.

Also in step 60, a secondary game symbol (e.g., a briefcase) appearing anywhere on the center reel 32 allows the player to play a secondary game. The symbols are arranged on the center reel so that only one of that certain symbol can appear when the center reel 32 is stopped. In one embodiment, the certain symbol allows the player to make a selection in a Deal Or No Deal game.

In step 62, it is assumed the player obtained the briefcase symbol and is allowed to play the secondary game, such as the Deal Or No Deal game. In another example, only if an activated briefcase symbol is on the same pay line as a winning symbol combination is the player is allowed to the play the secondary game. The secondary game carries over to multiple main games to encourage the player to play at least until the secondary game is terminated by the last briefcase being selected or the player taking the offered deal.

In step 64, the player may be granted a special award for a certain symbol appearing at the center between the two 3×5 matrices. The special award may only be granted if another event occurs, such as a special symbol combination. Since this scenario is very rare, the special award may be a high value progressive jackpot.

In step 66, the player may be granted an award for three or more of the same type of symbols being displayed on the center reel 32, irrespective of the pay lines. For example, the player may be granted three free games for three of the "free spins" symbols 35 (FIG. 1) being displayed on the center reel 32, assuming the free spins symbols 35 are activated, as described above. For more than three free spins symbols displayed, the player wins additional free games. The arrangement of symbols on the center reel 32 may be randomly changed for each game or stays the same. This type of sub-game, where a winning combination of symbols appears on a single reel, would be impractical for a reel displaying only three symbols. By the center reel 32 displaying seven symbols, the probability of three of the same type symbol being displayed is such that may occurs a few times during the player's session.

Figure 3:
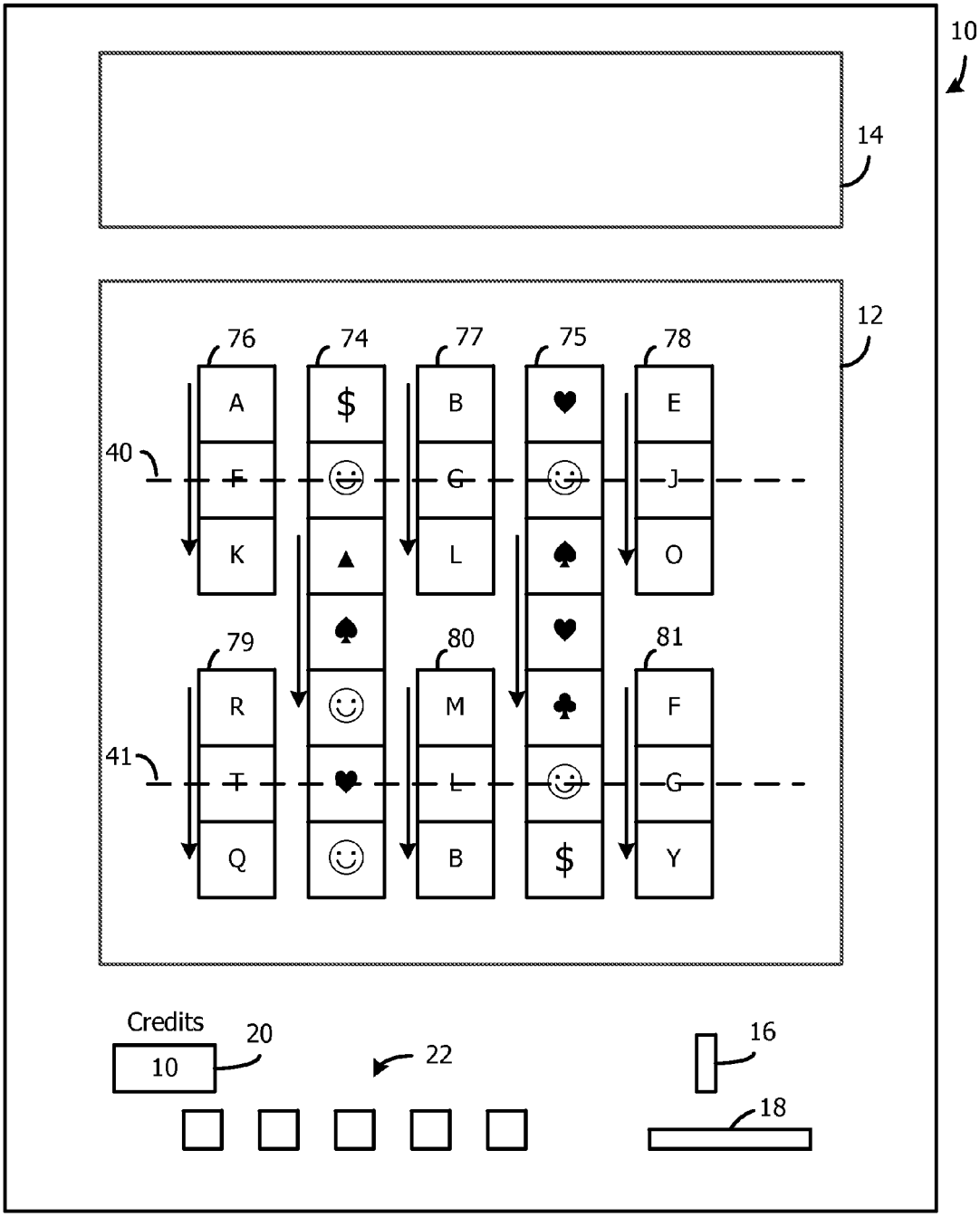
FIG. 3 illustrates the machine of FIG. 1 when in the free game mode, where two shared reels are used to increase the probability of the player winning.

In step 68, assuming a number of free games has been won due to the display of three of the symbols 35 on the center reel 32, the screen 12 displays the reel configuration shown in FIG. 3. During the free games, the player has a greater chance of winning by being provided two shared reels 74 and 74 between the regular reels 76-81. The shared reels 74 and 75 only contain special symbols that are not used by the regular reels 76-81. The symbols on the shared reels 74 and 75 may be the same as or different from the symbols on the center reel 32 during the main games. In one embodiment, all the symbols on the regular reels 76-81 are the same as on the reels 24-31 in FIG. 1. In another embodiment, the win probability is increased in the free games, and the arrangement and types of reel symbols are different to provide the increased probability of winning.

After the free games are played, the screen 12 reverts back to the reel configuration of FIG. 1.

The steps in FIG. 2 relating to the granting of the awards for the displayed symbols and the play of the secondary game may be in any order and not necessarily in the order presented in FIG. 2.

As seen, there are many advantages and additional possibilities when using the shared center reel that are not available when using all reels the same size.

Figure 4:
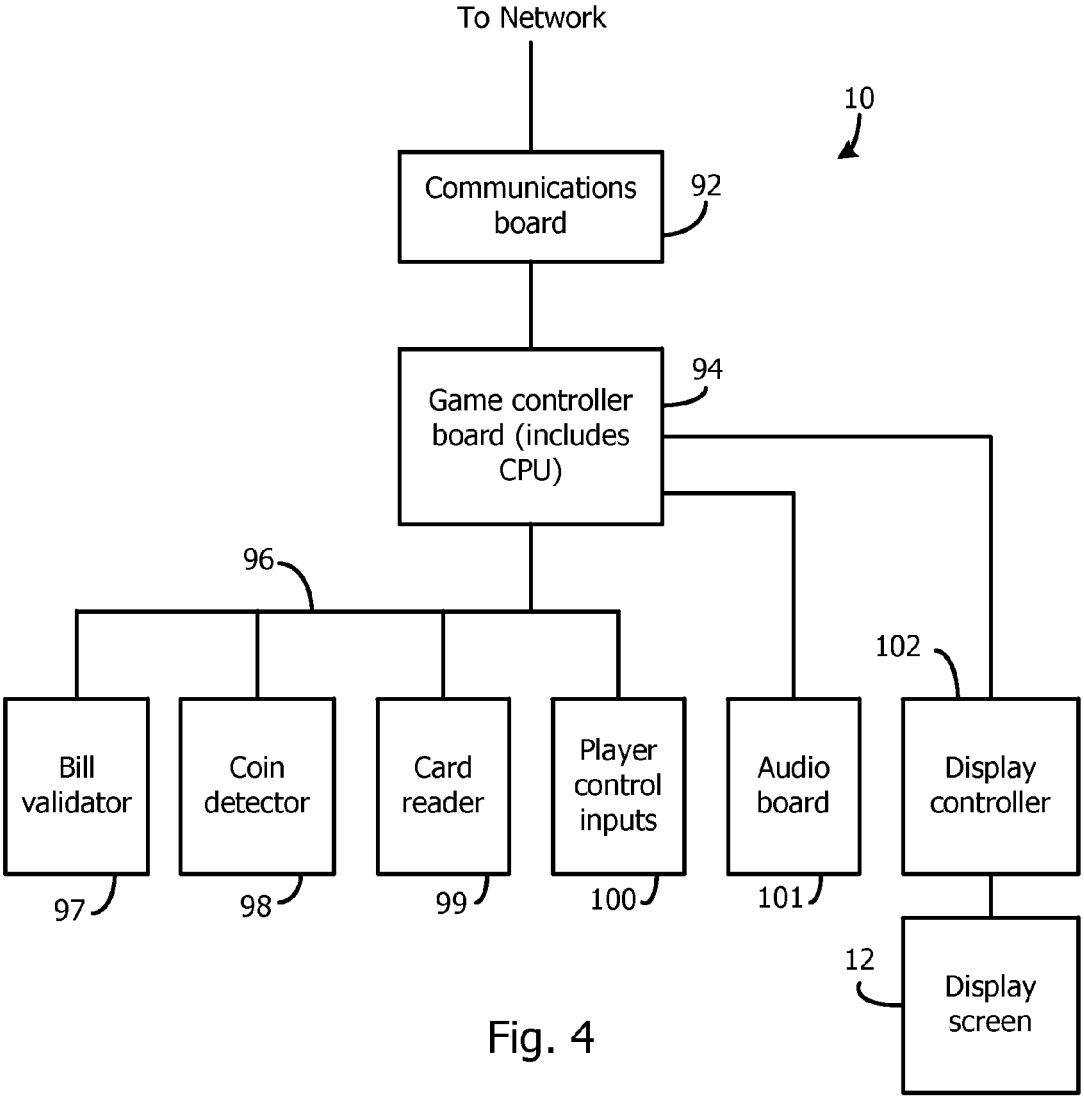
FIG. 4 is a diagram of basic functional units in the gaming machine of FIG. 1.

FIG. 4 is a diagram of the electronic functional units in the gaming machine 10, in accordance with one embodiment of the invention. The gaming system may use conventional hardware, and the software defines the game.

A communications board 92 may contain conventional circuitry for coupling the gaming machine 10 to a local area network (LAN) or other type of network using any suitable protocol. The gaming machine 10 may thus be monitored and programmed remotely, and the players' credits may be stored in a central system memory.

A game controller board 94 contains memory and a processor system for carrying out game programs stored in the memory and for providing the information requested by the network. The game controller board 94 primarily carries out the game routines.

Peripheral devices/boards communicate with the game controller board 94 via a bus 96 using, for example, an RS-232 interface. Such peripherals may include a bill validator 97, a coin detector 98, a player tracking card or other card reader 99, and player control inputs 100 (such as touch screen inputs). Payment may be by printed ticket, cash, electronic transfer or other means. An audio board 101 converts coded signals into analog signals for driving speakers. A display controller 102 converts coded signals to pixel signals for the display screen 12.

The electronics on the various boards may be combined onto a single board.

The gaming system has been described above as a dedicated physical gaming machine in a casino or other establishment. However, the gaming machine 10 may be a suitable generic computer or mobile device (smartphone, tablet, etc.) connected to a network/server via the internet and programmed to carry out the inventive methods. The gaming machine 10 of FIG. 1 may itself be a screen image in a virtual casino. Icon selection may be by touch screen, a mouse, a joystick, or other means. The gaming system may access a gaming site or a social website (e.g., Facebook) via the internet, wherein the remote gaming site controls various aspects of the game and allows remote players to participate in games using a virtual gaming machine. The player's inputs may be transmitted to a remote server and the results displayed to the player's display screen. For example, a player's mobile computing system (e.g., a smartphone) may detect winning symbol combinations by signals from the server informing the computing system that a winning combination has occurred. For gaming via the internet, the wagering would typically be by credit card or accessing an existing account. Awarding the player may be by crediting the player's account. For portable computing devices, Near Field Communications (NFC), such as Bluetooth, may be used as a player interface to play on an actual or virtual gaming machine 10.

Those skilled in the art may write the appropriate software to carry out the invention without undue experimentation. The hardware used may be conventional.

While particular embodiments of the present invention have been shown and described, it will be obvious to those skilled in the art that changes and modifications may be made without departing from this invention in its broader aspects. The appended claims are to encompass within their scope all such changes and modifications as fall within the true spirit and scope of this invention.

What is claimed is:

1. A gaming system comprising:

a display screen displaying an upper set of reels, a lower set of reels, and a larger shared reel that extends between the upper set of reels and the lower set of reels and is positioned to include one upper reel on each side thereof and directly adjacent thereto in the upper set of reels and to include one lower reel on each side thereof and directly adjacent thereto in the lower set of reels, the shared reel containing special symbols not contained by the upper set of reels and the lower set of reels, wherein symbols on an upper section of the shared reel are combinable with symbols on the upper set of reels; and wherein symbols on a lower section of the shared reel are combinable with symbols on the lower set of reels;

a payment component that is configured to receive a first payment and/or to provide second payment; and a game processing system programmed to:

establish a credit balance based on the first payment;

detect receipt of a wager;

reduce the credit balance based on a wager amount;

display rotation and stopping of the upper set of reels, the lower set of reels, and the shared reel; and determine winning symbol combinations using combinations of symbols formed by the symbols on the upper section of the shared reel and the symbols on the upper set of reels, and formed by the symbols on the lower section of the shared reel and the symbols on the lower set of reels, determine an award amount, if any, based on the winning symbol combinations, increase the credit balance based on at least a portion of the award amount, if any, and on receipt of a cash out input, provide the second payment, wherein the second payment is based at least a portion of the credit balance.

2. The system of claim 1 wherein the shared reel is in a center position between the reels in the upper set of reels and the reels in the lower set of reels.

3. The system of claim 2 wherein the upper set of reels comprises four reels, and wherein the lower set of reels comprises four reels.

4. The system of claim 3 wherein the symbols on the upper set of reels and the symbols on the upper section of the shared reel create an upper 3 ×5 matrix of symbols, and wherein the symbols on the lower set of reels and the symbols on the lower section of the shared reel create a lower 3 ×5 matrix of symbols.

5. The system of claim 4 wherein the shared reel displays seven symbols when stopped.

6. The system of claim 1 wherein the game processing system is also programmed to detect that an event has occurred and, in response, activate certain symbols on the shared reel, prior to the shared reel rotating, to increase a probability of the player winning an award.

7. The system of claim 1 wherein none of the special symbols displayed on the share reel is included in the symbol set for the upper set of reels and the lower set of reels, wherein the special symbols on the shared reel include wild symbols.

8. The system of claim 7 wherein the special symbols include free game symbols, and wherein, when a certain plurality of the free game symbols are displayed on the shared reel, the player wins a number of free games.

9. The system of claim 7 wherein the special symbols include secondary game feature symbols, wherein the display of at least one secondary game feature symbol on the shared reel allows the player to participate in a secondary game.

10. The system of claim 9 wherein additional secondary game feature symbols become activated on the shared reel upon detection of certain criteria being met.

11. The system of claim 10 wherein the certain criteria comprises detecting that the player placed a wager above a certain threshold level.

12. The system of claim 1 wherein the shared reel stops after all the reels in the upper set of reels and the lower set of reels have stopped.

13. The system of claim 1 wherein, upon detection of an awarding of free games to the player, an additional shared reel is displayed between the reels of the upper set of reels and the lower set of reels to increase a probability of the player winning during the free games.

14. The system of claim 13 wherein the additional shared reel has the same symbols as the shared reel.

15. The system of claim 1 wherein the gaming machine comprises a computing system interacting with a remote server via the Internet.

16. The system of claim 15 wherein the computing system detects winning symbol combinations by signals from the server informing the computing system that a winning combination has occurred.

17. A gaming method comprising:

displaying, on a display screen, an upper set of reels, a lower set of reels, and a larger shared reel that extends between the upper set of reels and the lower set of reels and is positioned to include one upper reel on each side thereof and directly adjacent thereto in the upper set of reels and to include one lower reel on each side thereof and directly adjacent thereto in the lower set of reels, the shared reel containing special symbols, wherein symbols on an upper section of the shared reel are combinable with symbols on the upper set of reels; and wherein symbols on a lower section of the shared reel are combinable with symbols on the lower set of reels;

via a payment component, receiving a first payment and/or providing a second payment;

carrying out a method by a programmed processing system comprising:

detecting a wager by a player;

displaying rotation and stopping of the upper set of reels, the lower set of reels, and the shared reel;

detecting winning symbol combinations using combinations of symbols formed by the symbols on the upper section of the shared reel and the symbols on the upper set of reels, and formed by the symbols on the lower section of the shared reel and the symbols on the lower set of reels;

determining an award amount, if any, based on the winning symbol combinations;

increasing a credit balance based on at least a portion of the award amount, if any; and on receipt of a cash out input, providing the second payment, wherein the second payment is based at least on a portion of the credit balance.

18. The method of claim 17 wherein the symbols on the upper set of reels and the symbols on the upper section of the shared reel create an upper 3 ×5 matrix of symbols, and wherein the symbols on the lower set of reels and the symbols on the lower section of the shared reel create a lower 3 ×5 matrix of symbols.

19. The method of claim 17 wherein the shared reel displays seven symbols when stopped, and the reels in the upper set of reels and the lower set of reels each display three symbols when stopped.

20. The method of claim 17 wherein none of the symbols displayed on the share reel is included in the symbol set for the upper set of reels and the lower set of reels, wherein the special symbols on the shared reel include wild symbols.

* * * * *